United States Patent [19]

Masterson, II

[11] Patent Number: 4,866,951

[45] Date of Patent: Sep. 19, 1989

[54] VEHICLE AIR CONDITIONING ACCUMULATOR WITH ADJUSTABLE CONNECTOR

[75] Inventor: James F. Masterson, II, Arlington, Tex.

[73] Assignee: EVAP, Inc., Arlington, Tex.

[21] Appl. No.: 229,176

[22] Filed: Aug. 5, 1988

[51] Int. Cl.[4] ..... F25B 43/00

[52] U.S. Cl. ..... 62/503; 62/512

[58] Field of Search ..... 62/503, 512

[56] References Cited

FOREIGN PATENT DOCUMENTS 2172694 9/1986 United Kingdom ..... 62/503

*Primary Examiner*—Lloyd L. King

*Attorney, Agent, or Firm*—Andrew J. Dillon

[57] ABSTRACT

An improved accumulator for use in a refrigeration circuit for vehicle air conditioning systems having a refrigerant reservoir with an enclosed interior with a lower region for the accumulation of liquid refrigerant and an upper region for the accumulation of vaporous refrigerant, an input connector coupled to the refrigerant reservoir for delivering liquid and vaporous refrigerant to the enclosed interior thereof, an output connector coupled to the refrigerant reservoir for extracting vaporous refrigerant therefrom, wherein at least one of the connectors if rotatably mounted allowing the accumulator to be coupled to a refrigerant circuit at a plurality of variable angular positions whereby a variety of refrigeration circuit configurations may be accommodated.

9 Claims, 2 Drawing Sheets

VEHICLE AIR CONDITIONING ACCUMULATOR WITH ADJUSTABLE CONNECTOR

BACKGROUND OF THE INVENTION

1. Field of the Invention

This invention relates generally to vehicle air conditioning refrigeration circuits, and specifically to an improved refrigerant reservoir for use in said systems.

2. Description of the Prior Art

A typical vehicle refrigeration circuit comprises a compressor, a condenser, an expansion valve/orifice tube or refrigerant metering device, and an evaporator as principal components. Refrigerant is circulated through the circuit to produce cooling. Energy is provided to the circuit by the compressor which is driven by the vehicle engine, and which serves to create a source of high pressure gas refrigerant which is allowed to pass through the condenser where the refrigerant dissipates heat and changes state to a high pressure liquid. The refrigerant then passes through the expansion valve and into the evaporator changing state from high pressure liquid, to low pressure liquid, and subsequently to low pressure gas, thereby removing heat from the vehicles passenger compartment and with the aid of a blower motor creates a cooling effect inside the vehicle. From the evaporator the refrigerant is then drawn back to the compressor in a low pressure gas form, where it is again compressed into high pressure gas for repetition of the cycle.

An accumulator is an additional typical refrigeration circuit component normally coupled between the evaporator and the compressor, and serving as a protective device for the compressor by separating liquid refrigerant from vaporous refrigerant, since it is undesirable to pass liquid refrigerant to the compressor. Additionally, an accumulator functions to remove moisture which may be mixed with refrigerant in the refrigeration circuit. Usually, a desiccant assembly is provided in the interior of the accumulator to absorb moisture.

The function of an accumulator is well established in refrigerant systems. Essentially, it consists of a device for modifying the flow of refrigerant in the system and for preventing liquid refrigerant from reaching the compressor. In operation, refrigerant is directed against the inner wall of the container and is caused to circulate about the inner periphery. In so doing, the velocity of the refrigerant is reduced to a great extent and any liquid contained in the refrigerant, be it liquid refrigerant, oil, or water, is encouraged to cling to the side wall and drain to the lower portion of the container, while vaporous refrigerant is accumulated in the upper portion of the container.

In many conventional accumulators, vaporous refrigerant is removed from the upper portion of the container by a u-shaped or j-shaped tubular conduit, having an opening at the upper end of the container and being routed through the lower end, further having a metering orifice at the lower end for controlled pick-up or reentry of liquid, particularly oil, to the flow of refrigerant, since it is also desirable that oil be maintained in the vapor flow to the compressor for lubrication.

With the advent of down-sized vehicles, the available space in vehicle engine compartments has been reduced such that clearance for air conditioning components and their required plumbing connections has necessitated separate plumbing arrangements for each model. Such separate plumbing arrangements have greatly complicated the installation and repair of vehicle air conditioning systems, and increased the cost of such systems.

In addition, it is often also necessary for the inlet and outlet of the accumulator to be in a particular geometric relationship to the refrigerant reservoir so that refrigerant lines can be connected to them. Thus, a variety of accumulators must be manufactured to satisfy the requirements of the plurality of vehicle types on the market or in current use.

SUMMARY OF THE INVENTION

The present invention is an improved accumulator for use in a refrigeration circuit for vehicle air conditioning systems. An enclosed refrigerant reservoir having a lower end for the accumulation of liquid refrigerant and an upper region for the accumulation of vaporous refrigerant is provided with an input connector coupled to said refrigerant reservoir for delivering liquid and vaporous refrigerant to the enclosed interior of the refrigerant reservoir, and an output connector coupled to the refrigerant reservoir for extracting vaporous refrigerant therefrom. At least one of the connectors is rotatably mounted wherein the accumulator may be coupled to a refrigerant circuit at a plurality of variable angular positions whereby a variety of refrigeration configurations may be accommodated.

The above as well as additional objects, features, and advantages of the invention will become apparent in the following detailed description.

BRIEF DESCRIPTION OF THE DRAWING

The novel features believed characteristic of the invention are set forth in the appended claims. The invention itself, however, as well as a preferred mode of use, further objects, and advantages thereof, will best be understood by reference to the following detailed description of an illustrative embodiment when read in conjunction with the accompanying drawings, wherein:

DETAILED DESCRIPTION OF THE INVENTION

Figure 1:
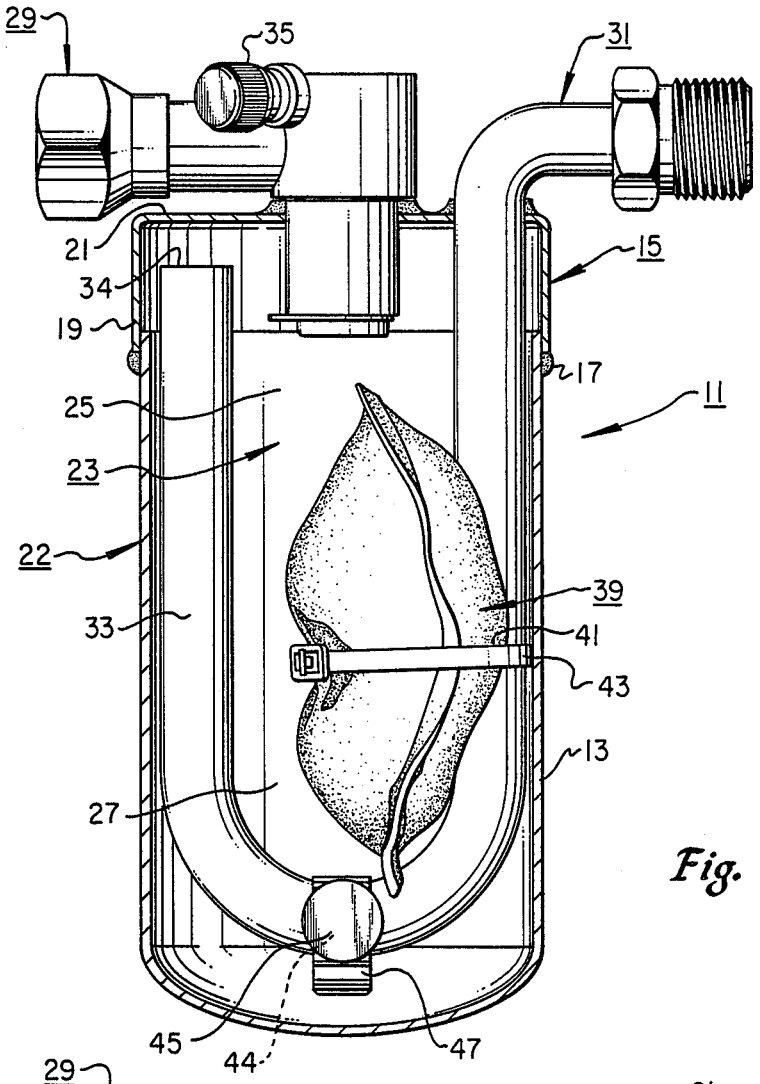
FIG. 1 is a cross-section view of the enclosed interior of a refrigerant reservoir of the present invention.

FIG. 1 depicts, in cross-section view, the accumulator of the present invention. Accumulator 11 consists of substantially cylindrical base 13 welded or otherwise secured to accumulator cap assembly 15 at coupling 17. Accumulator cap assembly 15 is a disk shaped cap 19 having a substantially planar surface 21. Together, cylindrical base 13 and coupled accumulator cap assembly 15 form an enclosed refrigerant reservoir 22, having an enclosed interior 23 with upper region for the accumulation of vaporous refrigerant and lower region 27 for the accumulation of liquid refrigerant.

Input connector 29 is concentrically carried on substantially planar surface 21 proximal to upper region 25, penetrating substantially planar surface 21 and forming a substantially right angle with said surface. Schrader valves 37, 35 are provided on input connector 29 to facilitate charging the refrigeration system or for the coupling of pressure switches or gauges (schrader valve 37 is obscured in FIG. 1).

Output connector 31 is peripherally disposed upon substantially planar surface 21 proximal to upper region 25, also penetrating substantially planar surface 21. Output connector 31 forms a u-shaped tube disposed in enclosed interior 23, terminating at port 34 which is disposed at upper region 25 adjacent to substantially planar surface 21 at the opposite periphery.

Of course, input connector 29 and output connector 31 may be disposed along any surface of accumulator 11 that defines the upper region 25, including the sides of either cylindrical base 13 or accumulator cap assembly 15, since input connector 29 and output connector 31 may be disposed on either rounded or substantially planar surfaces.

A dehydrator assembly 39 is preferably disposed in enclosed interior 23 for removing moisture from the refrigerant circuit in a manner well known in the art. Dehydrator assembly 39 consists of permeable sack-like container 41 filled with a desiccant, and secured to u-shaped tube 33 by dehydrator tie strap 43. A small perforation 44 (obscured) is provided in the lower-most portion of u-shaped tube 33 serving to introduce minute quantities of lubricant into the vapor stream extracted from enclosed interior 23 through output connector 31. A screen assembly 45 is positioned over said perforation 44 and coupled to u-shaped tube 33 by screen assembly tie strap 47.

Figure 2:
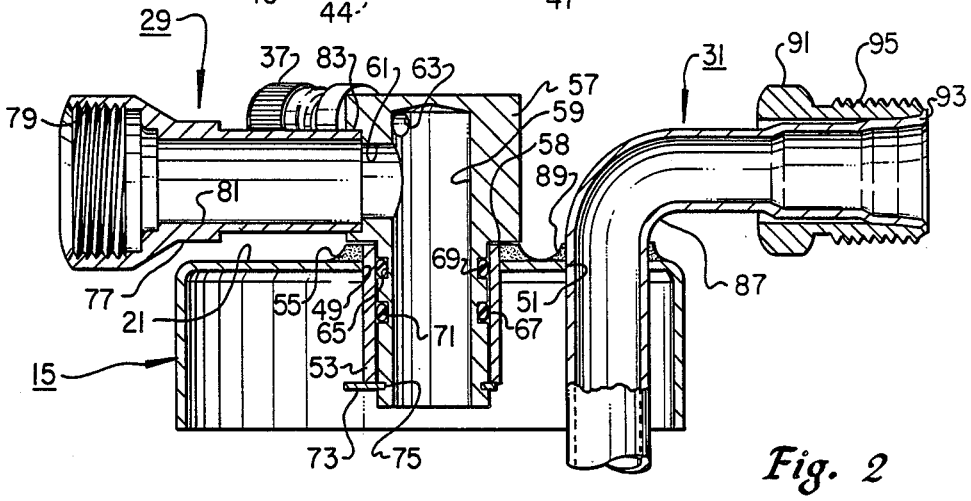
FIG. 2 is a cross-section view of the accumulator cap assembly of the present invention.

Referring now to the cross-section view of accumulator cap assembly 15 of FIG. 2, substantially planar surface 21 of accumulator cap assembly 15 has a input bore 49 concentrically disposed thereon. In addition, substantially planar surface 21 has an output bore 51 substantially peripherally disposed thereon.

Tubular input connector sleeve 53 is suspended in input bore 49, welded or otherwise secured to accumulator cap assembly 15 at coupling 55, and substantially disposed in enclosed interior 23 of enclosed refrigerant reservoir 22. Tubular input post 57 is in-part concentrically disposed within tubular input connector sleeve 53. The remaining portion of tubular input post 57, above shoulder 58, has a radius that exceeds that of tubular input connector sleeve 53, preventing its entry into tubular input connector sleeve 53.

Tubular input post 57 has a central passage 59 for the passage of liquid and vaporous refrigerant into enclosed refrigerant reservoir 22. A right angle channel 61 and schrader ports 63, 64 (schrader port 64 is not depicted in FIG. 2) are provided to communicate with central passage 59.

The portion of tubular input post 57 disposed within tubular input connector sleeve 53 has a pair of radially disposed and spaced apart grooves, namely upper radial groove 65 and lower radial groove 67. Upper O-ring seal 69 is disposed in upper radial groove 65 and lower O-ring seal 71 is disposed in lower radial groove 67, serving to seal the interface of tubular input post 57 and tubular input connector sleeve 53, while allowing input connector 29 to rotate to assume a plurality of variable positions relative to output connector 31. Snap ring 73 is disposed in snap ring radial groove 75 at the lower-most end of tubular input post 57, serving to secure tubular input post 57 within tubular input connector sleeve 53. Of course, other means for securing tubular input post 57 within tubular input connector sleeve 53 may be employed instead of snap ring 73.

Internally threaded tubular member 77 forms a substantially right angle with tubular input post 57, and is carried substantially parallel to substantially planar surface 21. Internal threads 79 are provided to couple input connector 29 with refrigeration circuits. Central passage 81 of internally threaded tubular member 77 serves to direct a mixture of liquid and vaporous refrigerant into central passage 59 of tubular input post 57 and downward into enclosed refrigerant reservoir 22. Once in the enclosed refrigerant reservoir 22, liquid refrigerant is separated from the vaporous refrigerant by force of gravity; vaporous refrigerant accumulates at upper region 25 of enclosed refrigerant reservoir 22, while liquid refrigerant accumulates at lower region 27 of enclosed refrigerant reservoir 22.

Output connector 31 of accumulator cap assembly 15 is peripherally disposed upon substantially planar surface 21. More specifically, output connector 31 is concentrically disposed in output bore 51. In one preferred embodiment, output connector 31 forms a continuous tubular member with u-shaped tube 33. Output connector 31 is fixedly secured to accumulator cap assembly 15 by coupling 89, which in one preferred embodiment may be a weld. Output connector 31 has a bight 87, so it forms an angle relative to substantially planar surface 21. A sliding threaded sleeve 91 is concentrically carried by output connector 31 and is secured thereon by flared end 93 of output tubular connector 31. Sliding threaded sleeve 91 has a plurality of external threads 95 which serve to couple output connector 31 with refrigeration circuits.

Figure 3:
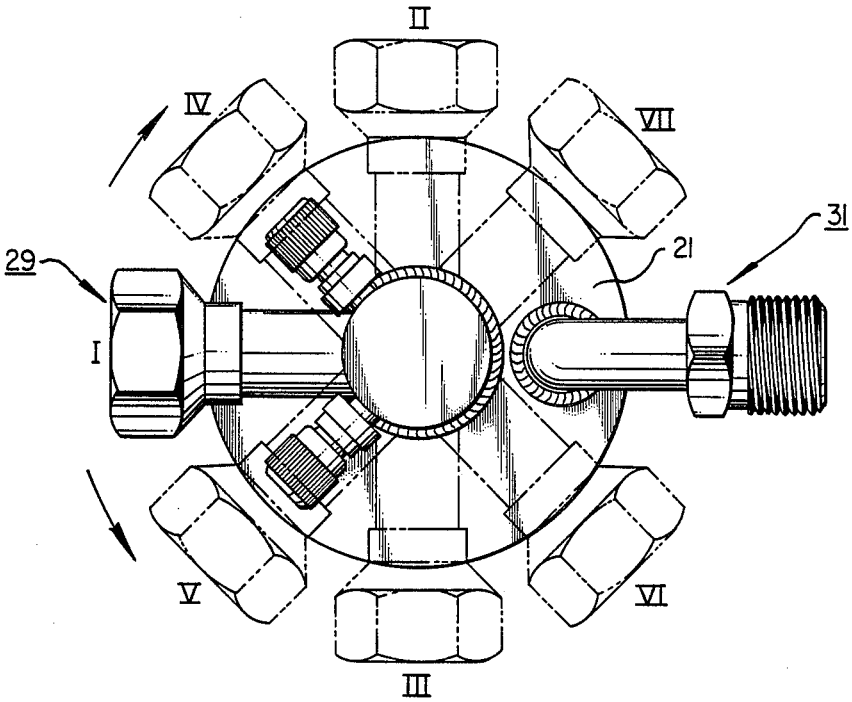
FIG. 3 is a top view of the improved accumulator of the present invention, with the input connector shown in multiple phantom views depicting a plurality of variable angular positions corresponding to a plurality of industry standard input and output connector configurations.

In operation, input connector 29 is rotatably carried by accumulator 11 while output connector 31 is fixedly carried by accumulator 11; therefore, input connector 29 may be coupled to a refrigerant circuit at a plurality of variable angular positions relative to output connector 31 Whereby a variety of refrigeration circuit configurations may be accommodated. The advantages of the present invention are apparent from FIG. 3 wherein an input connector 29 is shown disposed at a plurality of angular positions relative to output connector 31. The configurations depicted by B Roman numerals I through VII are standard General Motors Corporation configurations for late model vehicles and are also utilized by other vehicle manufacturers. With the present invention, a single accumulator 11 may be adjusted to adapt to each of the seven standard configurations shown in FIG. 3. Numerous other configurations are possible, rendering the present improved accumulator widely adaptable for use in a variety of refrigeration circuit configurations.

The present invention has a plurality of advantages over current accumulator systems. Specifically, the present invention maximizes installation adaptability by rendering one accumulator suitable for a plurality of refrigeration circuits. In addition, the present invention eliminates the need for speciality plumbing arrangements or "adapters" which are currently widely used in the industry. The elimination of these plumbing arrangements decreases the number of components and therefor increases the reliability of the present accumulator by minimizing the possibility of refrigerant leakage. Finally, the present invention decreases the clearance needed for accumulators, a desirable feature in view of the continuing trend to down-size vehicles, and the resulting decrease in engine compartment volume.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. An improved accumulator for use in a refrigeration circuit for vehicle air conditioning systems, comprising:

a refrigerant reservoir having an enclosed interior with a lower region for the accumulation of liquid refrigerant and an upper region for the accumulation of vaporous refrigerant;

region of said refrigerant reservoir and coupled to said refrigerant reservoir for delivering liquid and vaporous refrigerant to said enclosed interior of said refrigerant reservoir;

of said refrigerant reservoir;

an output connector disposed proximate to said upper region of said refrigerant reservoir for extracting vaporous refrigerant from said refrigerant reservoir; and at least one of said connectors comprising a tubular post having a central passage longitudinally disposed therein and coupled at one end thereof to said refrigerant reservoir and a radial passage disposed perpendicular to said central passage and in communication therewith, said tubular post being rotatably mounted about said central passage and having one end thereof within said refrigerant reservoir wherein said accumulator may be coupled to a refrigerant circuit at a plurality of variable angular positions whereby a variety of refrigeration circuit configurations may be accommodated.

2. An improved accumulator according to claim 1 wherein said input connector is fixedly coupled to said refrigerant reservoir, and said output connector is rotatably carried by said refrigerant reservoir for rotation relative to said input connector.

3. An improved accumulator according to claim 1 wherein said input connector is fixedly disposed proximate to said upper region of said refrigerant reservoir and said output connector is rotatably disposed proximate to said upper region of said refrigerant reservoir.

4. In an enclosed refrigerant reservoir for use in a refrigeration circuit of a vehicle air conditioning system, the improvement comprising:

a tubular connector disposed proximate to said upper region of said enclosed refrigerant reservoir comprising a tubular post having a central passage longitudinally disposed therein and coupled at one end thereof to said refrigerant reservoir and a radial passage disposed perpendicular to said central passage and in communication therewith, said tubular post being rotatably mounted about said central passage and having one end thereof within said refrigerant reservoir for coupling said enclosed refrigerant reservoir to said refrigeration circuit at a plurality of variable angular positions to accommodate a variety of refrigeration circuit configurations.

5. An apparatus according to claim 4 wherein said tubular connector is rotatably carried within an orifice provided in said enclosed refrigeration reservoir.

6. An apparatus according to claim 4 further comprising a means for sealing said enclosed refrigerant reservoir at an interface of said tubular connector and said enclosed refrigerant reservoir to prevent leakage from said enclosed refrigerant reservoir while allowing the rotation of said tubular connector relative to said enclosed refrigerant reservoir.

7. An improved accumulator for coupling between an evaporator and a compressor in refrigeration circuits of vehicle air conditioning systems, adapted to deliver vaporous refrigerant to said compressor, comprising:

a refrigerant reservoir having an enclosed interior with a lower region for the accumulation of liquid refrigerant and an upper region for the accumulation of vaporous refrigerant;

an outlet tube disposed proximate to said upper region of said refrigerant reservoir for coupling to said refrigeration circuit and for extracting vaporous refrigerant from said refrigerant reservoir;

an inlet tube disposed proximate to said upper region and rotatably carried by said refrigerant reservoir, said inlet tube comprising a tubular post having a central passage longitudinally disposed therein and coupled at one end thereof to said refrigerant reservoir and a radial passage disposed perpendicular to said central passage and in communication therewith, said tubular post being rotatable mounted about said central passage and having one end thereof within said refrigerant reservoir for assuming a plurality of configurations when said inlet tube is rotated relative to said refrigerant reservoir for coupling to a variety of refrigeration circuits for delivering liquid and vaporous refrigerant to said enclosed interior of said refrigerant reservoir; and means for sealing said outlet tube at said refrigerant reservoir to prevent leakage of refrigerant.

8. An improved accumulator according to claim 7 further comprising a substantially planar surface at said upper region, wherein said inlet tube is substantially centrally disposed upon a said substantially planar surface and said outlet tube is substantially peripherally disposed upon said substantially planar surface.

9. An improved accumulator according to claim 7 wherein said means for sealing comprises at least one O-ring seal disposed at an interface of said inlet tube and said refrigerant reservoir to prevent leakage of refrigerant while allowing said inlet tube to be rotated.

* * * * *

UNITED STATES PATENT AND TRADEMARK OFFICE

CERTIFICATE OF CORRECTION

PATENT NO. : 4,866,951

DATED : September 19, 1989

INVENTOR(S) : James F. Masterson, II

It is certified that error appears in the above-identified patent and that said Letters Patent is hereby corrected as shown below:

Column 5, line 18, before "region of" insert--an input connector disposed proximate to said upper--.

Column 5, line 22, delete--of said refrigerant reservoir;--.

Signed and Sealed this

Thirtieth Day of November, 1993

*Attest:*

*Attesting Officer*

BRUCE LEHMAN

*Commissioner of Patents and Trademarks*